United States Patent [19]

Stroh et al.

[11] Patent Number: 4,945,801

[45] Date of Patent: Aug. 7, 1990

[54] CLAMP WITH ADJUSTABLY POSTIONABLE HANDLE

[76] Inventors: Paul F. Stroh, 10229 42nd SW., Seattle, Wash. 98146; Dennis R. Gunn, Shiratori 2-5-13, Asou-ku, Kanagawa-ken, Kawasaki-shi, Japan

[21] Appl. No.: 242,425

[22] Filed: Sep. 9, 1988

[51] Int. Cl.[5] ..... G10D 3/06

[52] U.S. Cl. ..... 84/314 N

[58] Field of Search ..... 84/214, 314 N

[56] References Cited

U.S. PATENT DOCUMENTS 4,475,432 10/1984 Stroh ..... 84/314 N 4,690,028 9/1987 Steinberger ..... 84/314 N

*Primary Examiner*—Brian W. Brown

[57] ABSTRACT

A clamp for preventing the slippage of the strings of a guitar over the nut thereof comprises a plurality of blocks between which are disposed the strings of the instrument. A bolt passes through the blocks and is threaded into the end one thereof. Tightening of the bolt drives the blocks together causing the strings to become clamped therebetween. Means is provided for retaining the handle on the bolt in such a manner that it cannot fall off through casual handling and may be selectively reoriented on the bolt so as to obtain the optimum axial orientation of the handle on bolt when the handle is in the fully clamped position. The spacers may be formed as cylindrical members with a flattened side or a key groove.

14 Claims, 9 Drawing Sheets

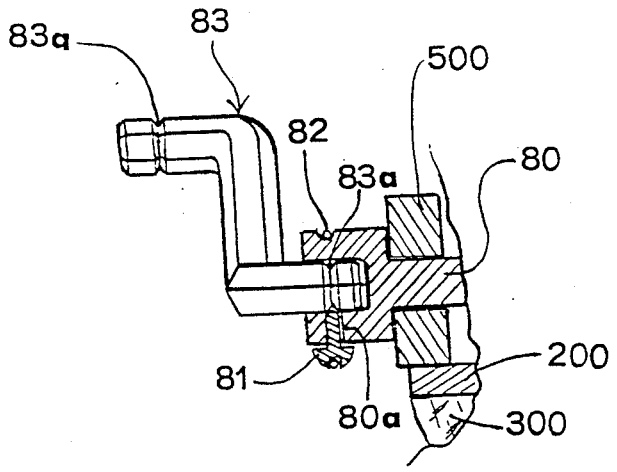
FIG. 10
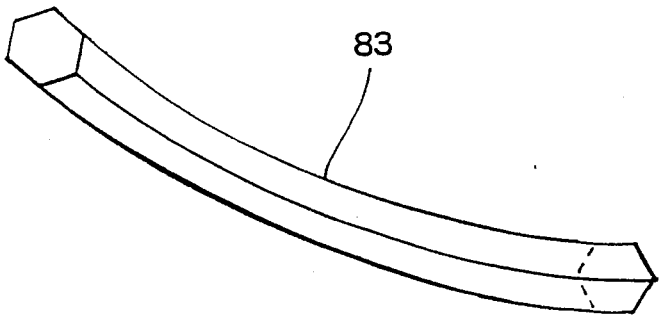

CLAMP WITH ADJUSTABLY POSTIONABLE HANDLE

FIELD OF THE INVENTION

The present invention relates generally to a clamp comprising a rotatable shaft, and a handle whose positional orientation about the axis of said rotatable shaft is incrementally adjustable, more specifically the invention relates to an improved clamp having an improved handle arrangement, of a type employed in stringed musical instruments.

PRIOR ART

Recently musical instruments, such as guitars, comprising a clamp for locking the strings so as to prevent undesired changes in the tension of the respective strings due to slippage about the tuner barrels, have become increasingly popular. An excellent example of such a system is disclosed in U.S. Pat. No. 4,475,432 which is hereby enclosed by way of reference. In the clamp system disclosed in the above document a channel member in which seven blocks are disposed is provided on the nut of a guitar. The central block is rigidly attached to the channel member and the other blocks are free to slide axially within the channel. Each of the respective blocks are formed with a center hole aligned along a common axis. The center hole of one of the end blocks is formed with a screw thread and a bolt having an allen head is inserted through the blocks and is threaded into the last one comprising the thread. The strings of the guitar are arranged between the respective blocks. With this arrangement rotating the bolt in one direction causes the blocks to cinch together and clamp the strings and conversely, rotation of the bolt in the other direction causes the blocks to loosen and release the strings.

The blocks in the above system are formed square or rectangular in cross section and must fit snugly in the channel so that they cannot rotate about the axis of the bolt which would result in altering the tension of the strings clamped between the strings and thereby defeat the purpose of the clamp.

The above system suffers the disadvantage that an allen wrench must be inserted each time the blocks are to be loosened to allow tuning or replacement of the strings. When not in use the allen wrench must be removed and stored since it tends to fall out of the receiving hole in the bolt, if left there during normal use of the guitar, and become lost. This storing and subsequent retreiving of the wrench tends to be a time consuming inconvenience to the musician and if during transit the wrench should become misplaced the musician finds himself in the dilema of not being able to tune or change the strings of his guitar.

It also suffers the disadvantage that precisely forming the blocks and the channel so that the blocks fit snugly in the channel but can slide fairly freelY longitudinally therein is difficult and expensive in a mass production process.

In order to overcome the above problems, in a variation on the above system produced by the Fender musical instrument company the allen bolt was replaced by a rod on one end pivotably supporting a handled cam arranged in such a manner that rotation of the cam by means of the handle caused the cam surfaces to bear on one of the end blocks so as to cinch the blocks together and clamp the strings.

The blocks of the above embodiment were cylindrical with flat end faces and an axially offcenter hole for receiving the rod. By making the hole offcenter and rigidly securing the center spacer block in the channel which was equal in width to the outer diameter of the spacers rotation of the blocks about the axis of the rod was somewhat avoided.

This variation also differs slightly in that, instead of one of the end blocks being threaded, as in the formerly disclosed embodiment, a nut is provided for cooperation with a thread formed on the end of the rod opposite the cam. This nut bears on the end block opposite that one on which the cam bears and is rotatably operable for adjusting the sum of the spaces occuring between the respective blocks while the cam handle is in the clamped position. In this way compensation can be made for the differences in string guages of the sets of strings which may be employed on the guitar so that it may be assured that when the cam handle is in the locked position it does not project from the guitar at an inconvenient angle which may pose a hazard to the hands of the musician and or prevent the instrument from fitting properly in its case.

This cam arrangement functions admirably but suffers the disadvantages of being relatively complex and expensive to produce.

Another disadvantage encountered in all of the above embodiments is that if the faces of the spacers are imprecisely formed and are slightly convex the string tends to become pinched at a single point between the spacers and if the spacer fits loosely in the channel member it can twist or pivot from side to side in the channel about an axis that is approximately normal to the bottom of the channel. This rocking or pivoting of the spacer results in changes of string tension which in turn translate into tuning aberrations thus defeating the purpose of the clamp.

SUMMARY OF THE INVENTION

In view of the above disclosed disadvantages in the prior art it is the object of the instant invention to provide a novel clamp handle arrangement of a simple and inexpensive construction which may be applied to advantage in a clamp according to the invention wherein a plurality of blocks are provided in a channel member so as to be slidable along the axis of the channel of said clamp and wherein the upper edges of the channel define means for aligning the strings at a given orientation between the spacer blocks.

It is a further object of the instant invention to provide a clamp handle arrangement in which the positional orientation of the clamp handle about the axis of the bolt is adjustable so as to assure that the handle may be disposed in the optimum position relative to the member on which the clamp is supported when the clamp is in a state in which the desired value of pressure is exerted on the members to be clamped.

It is a further aim of the invention to provide a block and channel structure which may be manufactured to close tolerences inexpensively.

According to the invention the above objects and others are acheived by providing a clamp handle which is operable to rotate a threaded rod member and which is firmly supported on the rod member in such a manner as to be prevented from falling off through casual handling of the instrument. A polyonal hole and a cooperating polygonal protrusion are formed on the handle and the rod in such a manner that the cooperating polyonal faces may be selectively disengaged amd the orientation of the handle relative to the rod adjusted and the faces be reengaged at a new orientation.

The polygonal hole may be formed in the handle and the protrusion may be formed on the rod or alternatively the rod may comprise the polygonal hole and the handle may comprise the polygonal protrusion.

In one embodiment the bolt takes a form essentially similar to a carriage bolt, preferably the polygonal portion between the head and the shank has six or eight sides, and the handle has a polygonal receiving hole portion so formed as to cooperate with the polygonal portion at the underside of the head of the carriage bolt. The depth to which the polygonal section of the bolt is received in the polygonal receiving hole of the handle is just great enough to ensure that the mating faces of the hole in the handle can firmly engage with those of the bolt.

With this arrangement when it is deemed to be desirable to change the orientation of the handle relative to the bolt, by lifting the guitar strings from between the spacer blocks and pushing the spacer blocks together it is possible while pushing the handle inwards or towards the center of the neck, to push the polygonal section of the bolt out from within the recieving hole in the handle by pushing on the end spacer into which the bolt is threaded. In the above manner the engaging faces of the polygonal hole and the bolt are disengaged and thus it becomes possible to change the orientation of the handle relative to that of the bolt and thereby obtain the relationship which provides the optimum clamp handle position while in the "clamped" mode.

In another embodiment which is a slight variation on the above embodiment, instead of a carriage type bolt, a conventional hexagonal headed bolt is employed the head of which having a threaded hole formed therein into which a large headed screw is received, the diameter of the head of which being larger than the distance between the opposing faces of the bolt on which the handle having the polyonal hole is supported.

With this arrangement when it is deemed desirable to change the position of the handle relative to the bolt, the screw threaded into the head of the bolt is partially or completely removed and the handle can be disengaged from the bolt and orientation thereof adjusted to the desired position. An advantage of this embodiment is that the orientation of the handle on the rod can be adjusted while the clamp is in the clamping mode and the strings are locked.

In order to make the orientation of the handle adjustable in finer increments the handle may be formed with a pair of polyonal receiving holes one at either end thereof. By shifting the orientation of the receiving holes relative to one another by, for example 30 degrees if the holes are hexagonal, it becomes possible to shift the orientation of the handle on the bolt in 30 degree increments instead of the 60 degree increments which would be available with only one polyonal hole provided.

In another embodiment an elastic catch means, which cooperates with a notch formed on the head of the bolt which runs through the spacers, is provided on the handle.

In another embodiment the handle takes the form of crank handle shaped hexagonal rod whose end portions fit into an allen type head of the bolt which runs through the spacers. As the holes in the above described embodiment were axially shifted relative to one another, so are the parallel hexagonal end portions of the handle. Thus, as described, the handle may be arranged on the bolt at any one of twelve axial orientations. A notch may be formed about the end portions of the rod for cooperation with an elastic ratchet means on the bolt for retaining the handle on the bolt.

The spacer blocks according to one aspect of the invention are formed circular with one flat side in cross section and the hole for receiving the shaft of the bolt for tightening the spacers is formed at the center of the circle.

According to another embodiment the spacers are formed as circular in cross section with a key groove formed at a portion thereof and the channel is also cylindrical with a key groove in which a key is disposed which cooperates with the key groove in the blocks to prevent the spacers from rotating within the channel.

IN THE DRAWINGS

FIG. 9 is a cross sectional view of handle showing the latching operation of the sixth embodiment of the invention.

FIG. 10 is a side elevation of the handle according to the sixth embodiment of the invention.

DETAILED DESCRIPTION OF THE INVENTION

Figure 1:
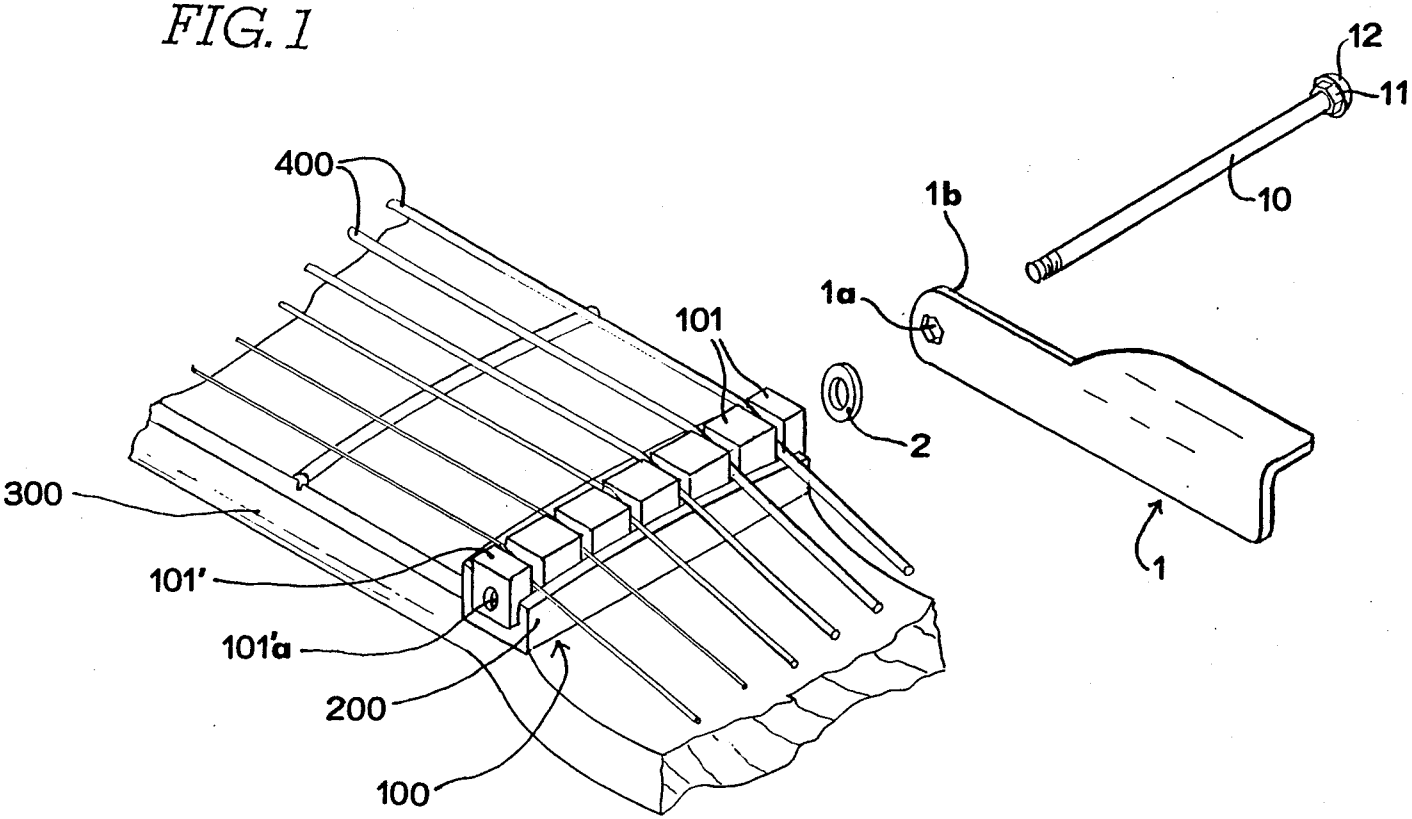
FIG. 1 is an exploded perspective view showing a nut clamp handle according to the first embodiment of the instant invention.

A handle arrangement for a string clamping nut according to the first embodiment of the instant invention is depicted in FIG. 1 wherein in a handle 1 pressed from sheet metal and comprises a hexagonal hole 1*a* at one end thereof. A bolt 10 comprises a hexagonal carriage type head on one end thereof and at the other end thereof a threaded section formed with left hand screw threads. The hexagonal portion 11 of the head is of essentially the same dimension as the hole 1*a* so that it may be received therein. The upper lens shaped portion 12 of the head is larger in diameter than the distance between opposing faces of the hexagonal hole 1*a* so that while the hexagonal portion 11 of the bolt is received within the hole 1*a*, the lower face of the lens shaped portion 12 mates with the outside face 1*b* of the handle 1. Preferably the thickness of the hexagonal portion 11 of the bolt 10 is less than that of the sheet metal from which the handle 1 is formed. Between the handle 1 and the first spacer 101 of the nut clamp 100 a washer 2 may be provided.

The spacers 101 of the clamp 100 are received within a channel member 200 which is attached at the nut position of the neck 300 of the guitar. Each of the spacers comprise a hole and the holes of the respective spacers are commonly aligned along a mutual axis parallel to that of the channel member 200. The hole 101'*a* in the last spacer 101', which aligns with those of the other spacers 101 of the clamp 100, is formed with a lefthand thread in which the lefthand threaded portion of the bolt 10 is received. The bolt 10 passes through hole 1*a* of the handle 1, through the washer 2, through the holes in the spacers 101 and is threaded into the hole 101'*a*. The center spacer 101 is rigidly attached to the channel member 200 by a screw (not shown).

In operation, while the hexagonal section 11 of the bolt is received within the hexagonal hole la the faces of the hexagonal portion 11 of the bolt cooperate with those of the hole 1*a* so that rotation of the handle about the axis of the bolt causes the bolt to rotate and thereby loosen or tighten the spacers by means of cooperation of the threaded portion thereof and the threaded hole 101'*a*. When the handle is rotated in the tightening direction bottom face of the lens shaped portion bears on the outer face of the handle 1 and the other face of the handle bears on the washer which in turn bears on the first spacer 101. As is well known the strings 400 of the guitar are disposed between the spacers so that tightening of the bolt drives the spacers together and strings become clamped therebetween.

When it becomes desirable to change the orientation of the handle 1 on the bolt 10, the bolt 10 is loosened and one or two of the thicker strings is removed from between the spacers 101. The spacers from between which the strings have been removed, the washer 2 and the handle are then pushed together which produces a gap between the bottom face of the lens shaped portion 12 of the bolt and the outer face 1*b* of the handle which is greater than the thickness of the hexagonal portion 11, therefore the hexagonal portion 11 is no longer received within the hole 1*a* and the handle may be rotated freely relative to the bolt 10. While in this state the orientation of the handle 1 relative to the bolt 10 is adjusted. Once the desired orientation has been acheived the hexagonal portion 11 is replaced within the hole 1*a* and the strings are returned to their positions between the spacers. Thereafter the handle once again is operable for tightening the spacers so as to clamp the strings.

In the above manner according to the instant invention the orientation of the handle 1 when the clamp is in the fully clamped state can be adjusted to be the most convenient position.

Figure 2:
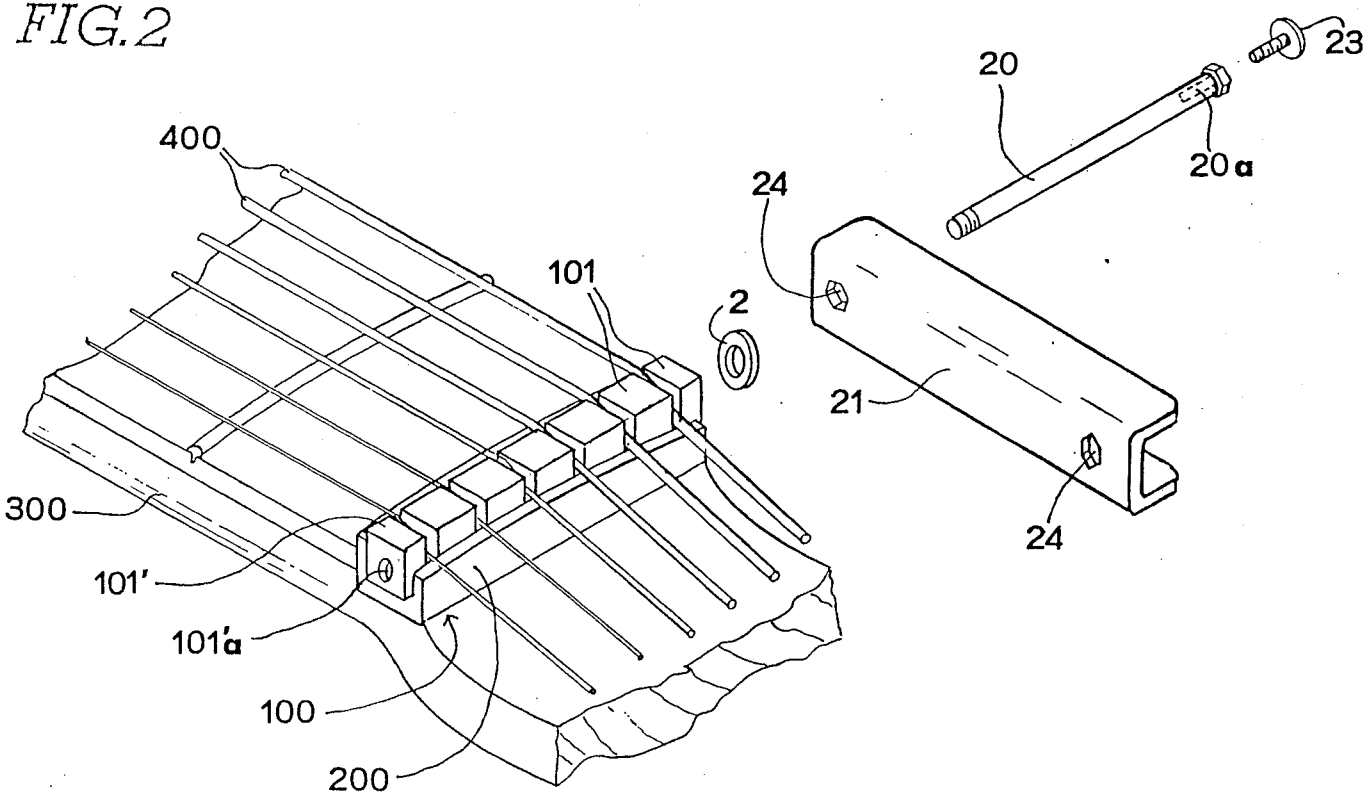
FIG. 2 is an exploded perspective view showing the second embodiment of the invention.

In a second embodiment according to the present invention shown in FIG. 2 all members other than the bolt 20, the screw 23 and the handle 21 are the same as in the first embodiment and therefore to avoid redundant disclosure a detailed description of those parts will ommitted and it will be understood that that like numerals represent like parts.

The handle 21 according to the second embodiment is pressed from sheet metal into a channel shape to give it rigidity and comprises two hexagonal holes 24 for receiving the head of a bolt 20. The bolt 20 like the bolt 10 in the previous embodiment has a small lefthand treaded portion at the end thereof. The orientations of the hexagonal holes 24 are mutually different by an angle of 30 degrees in this way by alternating between the two holes 24 of the handle 21, twelve axial orientations of the handle on the bolt are possible.

The head of the bolt 20 of the second embodiment is hexagonal and is of such dimensions as to be a snug fit when received in the holes 24 of the handle 21. A threaded hole 20*a* is formed in the top of the head of the bolt 20 in which a screw 23 having a head of a larger diameter than the distance between the opposing faces of the head of the bolt 20 can be received.

In this embodiment when the bolt 20 is threaded into the spacer 101', the handle 21 is disposed on the head of the bolt 20 and the screw 23 is tight within the hole 20*a* the head of the screw 23 retains the handle 21 on the bolt 20.

To change the orientation of the handle 21 on the bolt 20 it is only necessary to remove the screw 23, remove the handle 21 and then replace it in the desired orientation. It will be noted that this operation can be carried out while the bolt 20 is tight, thus the step of loosening the clamp required in the first embodiment may be omitted.

Figure 3:
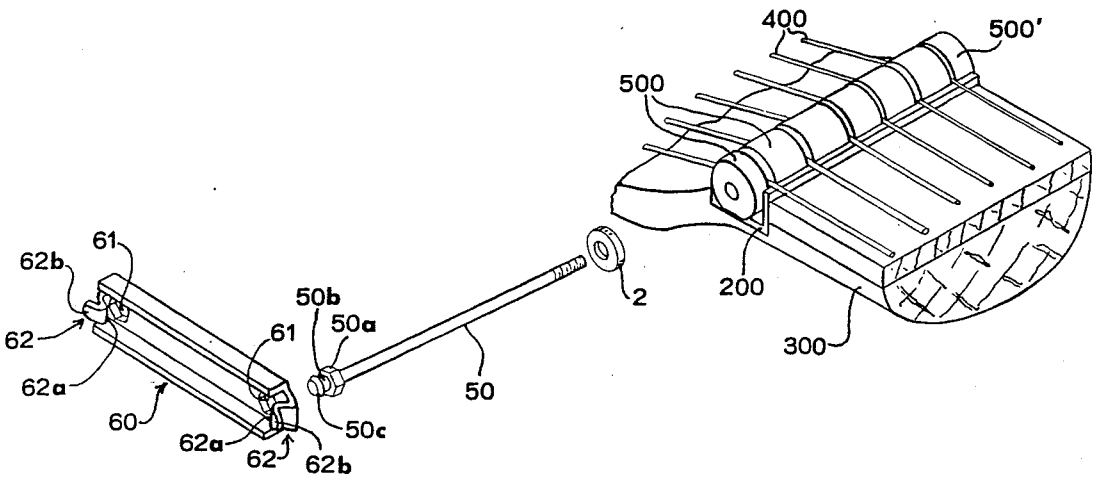
FIG. 3 is an exploded perspective view showing the third embodiment of the invention.

In a third embodiment according to the instant invention shown in FIG. 3 the channel member 200 is essentially the same as in the first embodiment. The spacers 500 of the third embodiment are identical in function to those 101 of the first embodiment however, for ease of manufacturing the spacers 500 of the third embodiment are formed as hollow cylinders with a flat 50*a* ground on one side. The flat 500*a* mates with the bottom of the channel member 200 so as to keep the spacer members from rotating about the axis of the bolt 50 which runs through the central holes of the respective spacers. As in the previous embodiment the central spacer is attached to the channel member by means of a screw (not shown) and the center hole of the last spacer 500' is formed with a left hand thread.

The bolt 50, of the third embodiment, by which the spacers 500 are tightened as in the previous embodiments is formed with a lefthand thread which mates with that of the spacer 500'. The head of the bolt 50 has a hexagonal portion 50*a* and above that, a short cylindrical section at the top which a button 50*c* of larger diameter than cylindrical section 50*b* is formed.

The handle 60 of the third embodiment as in the second embodiment has formed at either end thereof a pair of hexagonal holes 61 for receiving the hexagonal portion 50*a* of the bolt 50 and elastic tabs 62 for engaging the upper cylindrical portion 50*b* and button portion 50*c* of the bolt. The respective tabs are so formed that while the hexagonal portion of the bolt is received within the adjacent hole 61 the engaging portion 62*a* thereof is elastically biased against the cylindrical portion 50*b* of the bolt immediately under the button 50*c*. In this manner the handle is elastically retained on the head of the bolt 50. The engagement between the surface 62*a* and the cylindrical portion can be released by manually applying pressure to the thumb-tab 62*b* so that the handle may be easily removed.

Thus according to the third embodiment the handle may be easily and conveniently snapped on and off the head of the bolt and the orientation thereon changed at will.

Figure 4:
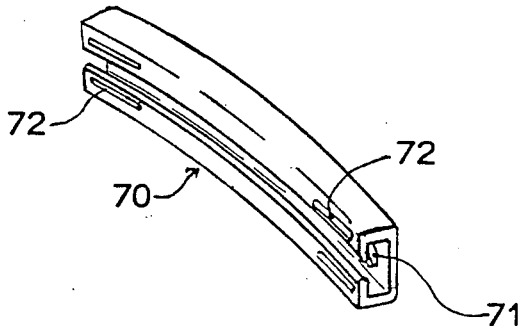
FIG. 4 is a perspective view showing a handle according to embodiment of the invention.
Figure 5:
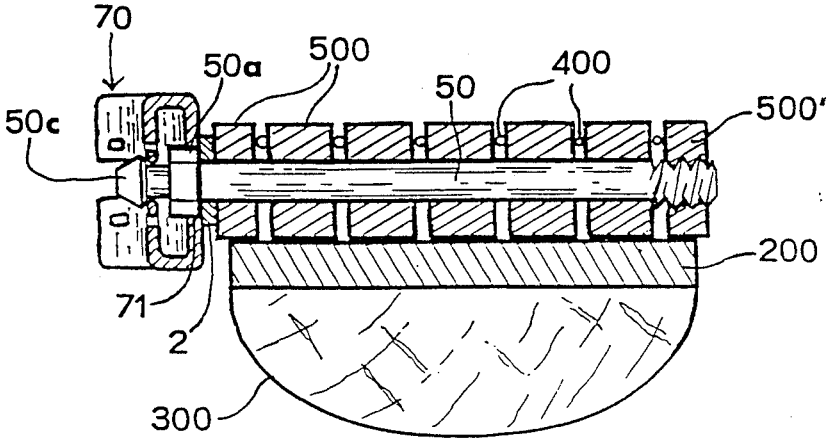
FIG. 5 is a cross sectional view showing the operation of the handle according to the fourth embodiment of the invention.

In a fourth embodiment shown in FIGS. 4 and 5 all elements other than the handle 70 are the same as those set out in the description of the third embodiment set out above. The handle 70 of the third embodiment comprises a pair of hexagonal holes 71 formed at either end thereof (only one is visible in the figs.) as in the second embodiment for receiving the hexagonal portion of bolt 50. The handle 70 is formed of sheet metal formed into a channel having roughly a C shaped cross section. When the hexagonal portion of the bolt 50 is received in one of the holes 71 the button protrudes out between the facing edges of the of the C-shaped channel. The gap between the opposing faces of the C-shaped channel is slightly smaller than the diameter of the button section 50c of the bolt therefore in order for the button section to protrude therebetween the channel member must be slightly deformed outwards. In order to facilitate this, slots 72 are formed just behind the sections of the faces of the channel which engage with the button section of the bolt. In the above arrangement the handle can be pushed onto the head of the bolt and the slots 72 allow the engaging faces of the handle to deform outwardly. When the button 50c has passed completely through, the engaging sections elastically return inward and lightly engage the cylindrical section 50b. In the above manner the handle according to the fourth embodiment is elastically retained on the head of the bolt.

Figure 6:
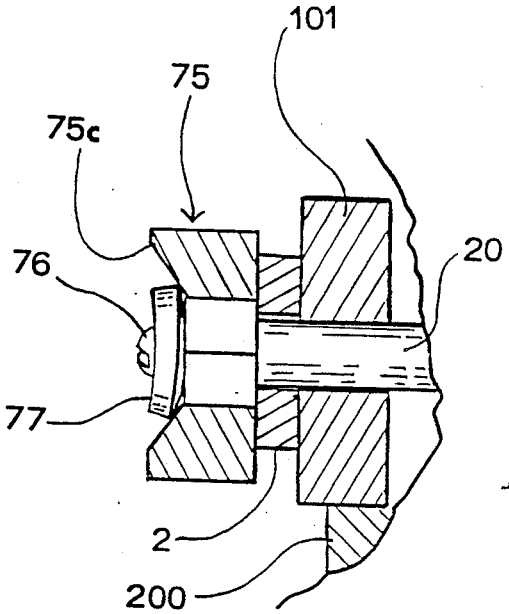
FIG. 6 is a cross sectional view showing a handle arrangement according to a fifth embodiment of the invention.
Figure 7:
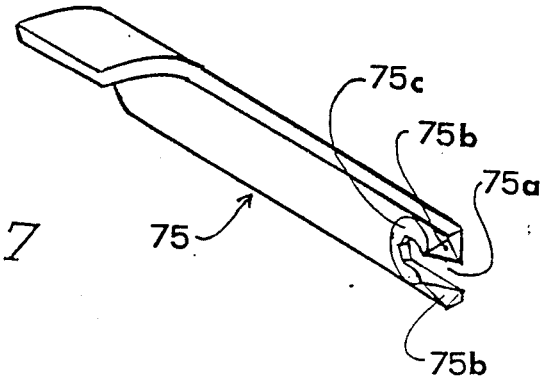
FIG. 7 is a perspective view of the handle according to the fifth embodiment of the invention.

In the fifth embodiment of the invention shown in FIGS. 6 and 7 all elements other than the handle 75, the screw 76, and the elastic washer 77 are the same as those indicated by corresponding numerals in the second embodiment.

The handle 75 of the fifth embodiment is formed with a slot 75a whose parallel faces are seperated by a very slightly greater distance than the distance between the parallel faces of the head of the bolt 20. The thickness of the head of the bolt is less than that of the handle and an elastic washer greater in diameter than the head of the bolt is retained thereon by means of a screw 76. At the open end of the slot tapering faces 75b are formed adjacent thereto so that the thickness of the handle adjacent the slot gradually increases toward the inward end thereof. At the innermost end of the slot a conical indentation is formed in the surface of the handle.

The above described tapering surfaces cooperate to elastically deform the elastic washer 77 when the handle is inserted into the gap between the washer 77 and the washer 2, reaching a point where the washer is deformed the most just before reaching the conical indentation. When the handle reaches the position where the washer is recieved in the conical indentation the washer 77 can return somewhat in the direction of its undistorted shape. In this manner the conical indentation 75c and the washer 77 cooperate to elastically retain the handle at the position where the washer is centered in conical indentation 77 thereby elastically retaining the handle 75 on the bolt 20.

It will be appreciated that the tapering surfaces may alternatively be formed on the side of the handle facing the clamp 100 and the elastic washer accordingly provided at the inside side thereof.

Figure 8:
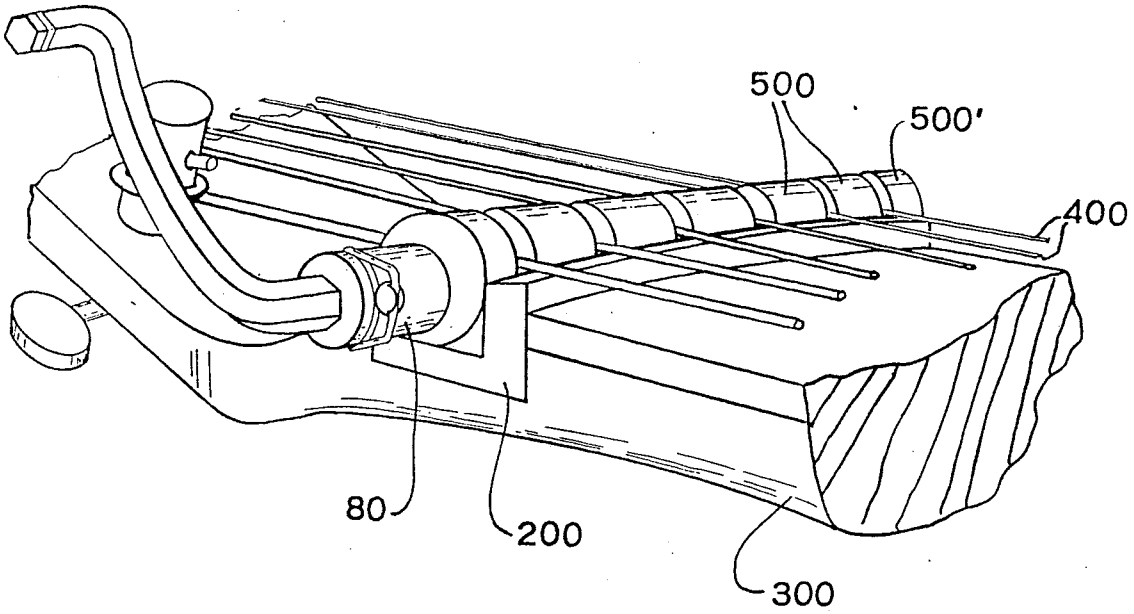
FIG. 8 is a perspective view showing the sixth embodiment of the invention.

A sixth embodiment of the instant invention is depicted in FIGS. 8–10.

The sixth embodiment of the invention comprises an allen type headed bolt 80 which replaces the bolt 50 of the third embodiment. A hole 80a is formed in one side of the head of the bolt 80 which hole 80a penetrates to the interior of the hexagonal wrench receiving portion of the head. Disposed in the hole 80a is a member 81 having the general shape of a rounded headed screw with no threads. The member 81 is elastically biased into the hole 80a by means if a wire spring 82. The shank of the member 81 is just long enough that the hemispherical end portion thereof protrudes slightly into the hexagonal wrench recieving hole of the bolt.

A handle 83 is formed of a hexagonal rod of the proper dimensions to fit snugly into the hexagonal hole of the bolt 80. The end portions of the handle 83 are bent in opposite directions at right angles to the general axis of the handle. The central section of the handle 83 is bent so as to mutually offset the orientations of the end portions thereof by approximately 30 degrees as will best be appreciated by considering FIG. 10. Formed around the end portions of the handle 83 are slots 83a which are so positioned that when an end portion of the handle is inserted into the hexagonal hole of the bolt 80 the hemispherical end portion of the member 81 is driven by the biasing force of the spring wire 82 thereinto.

Thus in order to remove the handle the member 81 must be thrust outwards by engagement with a surface of the groove 83a against the biasing force of the spring wire 82. Thus with this arrangement the handle 83 is elastically retained on the bolt 80.

Figure 11:
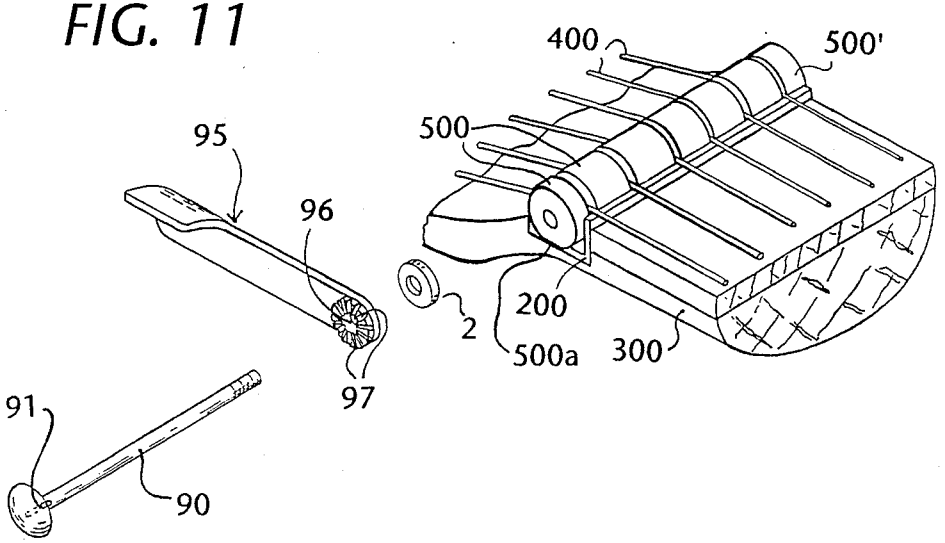
FIG. 11 is an exploded view showing the seventh embodiment of the instant invention.

In a seventh embodiment of the instant invention shown in FIG. 11 all members other than the bolt 90 which passes through the spacers and the handle 95 are the same as the those disclosed above in connection with the third embodiment, therefore to avoid redundant disclosure only the handle 95 and the bolt 90 will be described hereinbelow.

The handle 95 according to the invention comprises a circular hole 96 through which the shank of the bolt is inserted. Immediately surrounding the circular hole is a crenelated section comprising a plurality of slots 97 radiating from the center of the hole 96. Immediately beneath the head of the bolt 90 the shank is formed with a hole at right angles to the axis thereof in which pin 91 is recieved. The pin 91 projects from either side of the shank of the bolt. When the bolt is inserted through the hole 96 through the washer 2, the spacers 500, and is threaded into the threaded into the last spacer 500, the pin 91 can be received in the crenelations thereof so that rotation of the handle 95 causes the bolt to turn via the engagement between the walls of the slots 97 of the crenelated portion and the pin 91.

When it becomes desirable to adjust the orientation of the handle 95 relative to the bolt, somewhat similarly to the first embodiment, the bolt is loosened and one or two of the larger strings are removed from between the spacers and the handle and spacers are pushed together which produces a gap between the bottom of the head of the bolt 90 and the pin 91 becomes free of the slots 97 in the crenelated portion of the handle. In this state the handle 90 may be rotated relative to the bolt 95, to the desired position. Once the desired relationship is obtained the strings are returned to their positions between the respective spacers and the pin 91 once again becomes recieved in the slots of the crenelated portion at the newly selected orientation.

Figure 12:
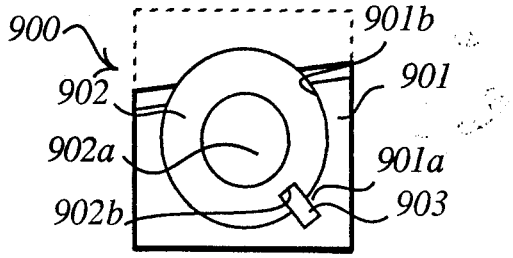
FIG. 12 is a side elevational showing the spacer blocks and channel according to an eighth embodiment of the invention.

In FIG. 12 a channel and spacer arrangement is illustrated according an eighth embodiment of the invention. The handle and bolt arrangement may be any of the ones mentioned above, and therefore a description thereof will be emitted for clarity.

According to a clamp 900 of the eight embodiment, the spacer blocks 902 are formed as cylinders with a center hole 902*a* and are received within the channel 901*b* of the block 901. A key groove 901*a* is formed in which a key 903 is press fitted. The spacers 902 comprise a key slot 902*b* into which the key may be slidingly received. The key 903, which runs the length of the channel 901, prevents the spacers from rotating therein but allows them to slide along the axis of the channel 901.

With this embodiment the channel may be easily formed by drilling a longitudinal hole 901*b* through a parallel piped block 901 then cutting away the upper section of the block (dotted line) and forming the key way 901*a*. The blocks 902 can also be formed easily by simply forming a keyway in a tubular member and cutting it into sections (blocks 902) of the appropriate length for spacing the strings. This method can provide inexpensive precisely formed parts because the critical dimensions can be formed by drilling and lathing the cooperating cylindrical surfaces.

Figure 13:
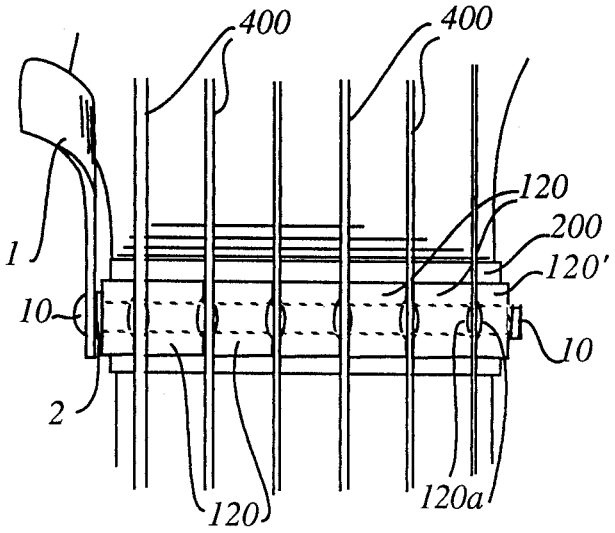
FIG. 13 is a plan view showing the spacers according to the ninth embodiment of the invention.

In the ninth embodiment of the invention depicted in plan view in FIG. 13 every part but the spacers 120 are the same as those disclosed in connection with the first embodiment disclosed above therefore it will be understood that like numerals indicate like parts.

The spacers 120 according to the ninth embodiment have generally flat end faces for engaging the strings. At the center of one or both of the flat end faces of the spacers 120 are formed slight hollows 120*a*. Due to the existence of these hollows 120*a* the string is not clampingly engaged at the portion of the spacer directly above the bolt but it is is so engaged at two places above and at either side of the bolt. Since the center of effort of the bolt is at roughly the center of the spacer and the engaging faces are on either side of the center of effort, when the spacers are driven together by engagement of the threads of the bolt with those of the registered hole in the spacer 120' and the head of the bolt with the end spacer 120 a stable relationship between the respective spacers must result be cause the engaging force of the spacers is applied to two points on each of the respective strings and those two points are at opposite sides of the center of effort of the bolt.

With the above embodiment even if the faces of the spacers are not formed perfectly normal to the center hole of the spacers and the spacers are slighty loose in the channel, when the clamping force of the bolt is applied to the spacers they tend to twist slightly in the groove and the clamping force becomes essentially evenly distributed at both sides of the spacer, thus establishing a stable relationship between the spacers in which theY cannot twist relative to one another in the clamping mode.

Thus it will be appreciated from the above that the present invention provides a convenient handle of a simple, inexpensive and compact construction for an improved clamp of the type used in preventing the slippage of strings across the nut of a musical instrument such as a guitar.

Although in the above embodiments the bolt and threaded spacer are set out as having lefthand threads it will be understood that a clamping nut according to the invention may comprise a righthand threaded bolt.

It will be appreciated that numerous variations on and recombinations of the elements of the above embodiments may be conceived and executed without departing from the scope and spirit of the invention as set forth in the appended claims.

What I claim:

1. A clamp comprising:

a plurality of blocks said blocks having gaps therebetween;

a threaded bolt means, said threaded bolt means being defined by a threaded bolt having a threaded stud portion and being rotatable for cooperating with a screw thread formed on one of said plurality of blocks for driving at least one of said blocks in an axial direction for changing the width of said gaps between said blocks;

a string aligning means for aligning a string of a musical instrument at a predetermined orientation in one of said gaps;

a handle for rotating said bolt means relative to said plurality of blocks; and a handle retaining means, said handle retaining means retaining said handle means on said bolt so as to prevent said handle from falling from said bolt at any and all possible orientations of said clamp and said handle retaining means being selectively releasable for allowing selective reorientation of said handle relative to said bolt.

2. A clamp as set out in claim 1 wherein said bolt comprises a polygonal head section defining a plurality of faces and said retaining means is defined by a retaining section, said retaining section being defined on a side of said head that is at the opposite side of said polygonal head section from said threaded section of said bolt, so as to protrude radially beyond said faces of said polygonal section so as to prevent removal of said handle from said polygonal head section in the axial direction of said bolt opposite from the direction of said threaded stud section of said bolt and said handle comprises a polygonal hole for receiving said polygonal head section so as to prevent rotation of said handle relative to said bolt while said polygonal head section is received in said hole.

3. A clamp as set out in claim 1 wherein said handle retaining means is defined by an elastically deformable member, retained on said bolt, which protrudes into a notch in said handle.

4. A clamp as set out in claim 1 wherein said handle retaining means is defined by an elastic portion provided on said handle which protrudes into a notch formed on said bolt.

5. A clamp as set out in claim 1 wherein said handle comprises two polygonal holes, each of said two polygonal holes defining a plurality of faces and wherein no plane defined by a face of one of said two polygonal holes is parallel to a plane defined by a face of the other of said two polygonal holes.

6. A clamp as set out in claim 1 further comprising means for retaining a plurality of strings of a musical instrument at predetermined spacing intervals between a head of said threaded bolt means and said threaded block.

7. A clamp as set out in claim 6 wherein said spacing means defines cylindrical spacer blocks.

8. A clamp as set out in claim 7 wherein the cross section of said blocks taken in a plane that is normal to the registered central holes thereof defines a circular periphery with a portion thereof removed and wherein no portion of said blocks protrude beyond said circular periphery and said blocks have flat faces at either end thereof for engaging the strings and have a flat side defined at a portion thereof by said removed portion of said circular periphery for engaging a surface of said channel for preventing the rotation of said slidably received blocks in said channel.

9. A clamp as set out in claim 7 wherein said spacer blocks are cylindrical with a keyway for receiving a key.

10. A clamp as set out in claim 6 wherein said plurality of blocks comprise registered holes through which said threaded bolt means passes.

11. A clamp as set out in claim 10 wherein a block of said plurality of blocks comprises a generally flat string engaging face in which is formed a concave portion.

12. A clamp for clamping a plurality strings of a musical instrument at a predetermined portion thereof, in which a plurality of blocks having registered holes, a bolt actuable for driving said blocks together disposed so as to pass through said registered holes and a channel member in which a plurality of said blocks are received and to which one of said blocks is rigidly attached, wherein the cross section of said blocks taken in a plane that is normal to the registered central holes thereof defines a circular periphery and said blocks have flat faces at either end thereof for engaging the strings and have a flat side defined at a portion thereof by said removed portion of said circular periphery for engaging a surface of said channel for preventing the rotation of said slidably received blocks in said channel.

13. A clamp for clamping a plurality strings of a musical instrument at a predetermined portion thereof, in which a plurality of blocks having registered holes, a bolt actuable for driving said blocks together disposed so as to pass through said registered holes and a channel member in which a plurality of said blocks are slidably received and to which one of said blocks is rigidly attached, wherein said blocks are generally cylindrical in form and have flat faces at either end thereof for engaging the strings and have a key groove longitudinally formed at a portion thereof for slidably engaging a key member and the channel of said channel member is generally cylindrical having an open section at the top thereof through which the tops of said blocks protrude and a key groove formed at another portion thereof in which said key member is received, said key member being so formed as to prevent the rotation of said slidably received blocks in said channel.

14. A clamp as set out in claim 1 wherein said bolt comprises a head section, on which a handle engaging portion is defined for preventing rotation of said bolt relative to said handle and said retaining means is defined by a retaining section, said retaining section being defined on a side of said head that is at the opposite side of said engaging portion of said bolt from said threaded section of said bolt, and wherein said handle comprises a bolt engaging section for preventing rotation of said bolt relative to said handle and one of said handle engaging portion and said bolt engaging portion defines a plurality of radial grooves.

* * * * *